US007547017B2

(12) United States Patent
Mizubata et al.

(10) Patent No.: US 7,547,017 B2
(45) Date of Patent: Jun. 16, 2009

(54) SHEET FEED DEVICE

(75) Inventors: Tsuyoshi Mizubata, Tokyo (JP); Kiyoshi Hata, Tokyo (JP); Masahiko Fukushima, Tokyo (JP); Masahiro Ogawa, Yamanashi-ken (JP); Hiroyuki Yamada, Yamanashi-ken (JP); Masaki Higuchi, Yamanashi-ken (JP)

(73) Assignees: Konica Minolta Business Technologies, Inc. (JP); Nisca Corporation (JP)

( * ) Notice: Subject to any disclaimer, the term of this patent is extended or adjusted under 35 U.S.C. 154(b) by 413 days.

(21) Appl. No.: 11/182,285

(22) Filed: Jul. 14, 2005

(65) Prior Publication Data

US 2006/0071393 A1 Apr. 6, 2006

(30) Foreign Application Priority Data

Aug. 20, 2004 (JP) ..... 2004-241186

(51) Int. Cl.
*B65H 7/02* (2006.01)
*G03G 15/00* (2006.01)

(52) U.S. Cl. ..... 271/265.03; 271/10.02; 399/370; 399/376; 399/367

(58) Field of Classification Search ..... 271/4.02, 271/10.02, 145, 152, 110, 265.01, 265.02, 271/265.03; 399/367, 370, 376; 250/599.4
See application file for complete search history.

(56) References Cited

U.S. PATENT DOCUMENTS

| | | | | |
|---|---|---|---|---|
| 5,745,817 | A * | 4/1998 | Yamazaki et al. | 399/16 |
| 5,915,690 | A * | 6/1999 | Surya | 271/265.01 |
| 6,256,473 | B1 * | 7/2001 | Kamanuma et al. | 399/367 |
| 6,794,633 | B2 * | 9/2004 | Iwasaki | 250/221 |
| 6,796,559 | B2 * | 9/2004 | Hirota et al. | 271/225 |
| 6,804,474 | B2 * | 10/2004 | Morita et al. | 399/23 |
| 7,144,008 | B2 * | 12/2006 | Suzuki | 271/265.04 |
| 7,172,195 | B2 * | 2/2007 | Sano et al. | 271/262 |
| 2003/0137703 | A1 * | 7/2003 | Aoki et al. | 358/498 |
| 2005/0012259 | A1 * | 1/2005 | Sano et al. | 271/10.01 |

FOREIGN PATENT DOCUMENTS

| | | |
|---|---|---|
| JP | 58-156873 | 9/1983 |
| JP | U-62-96048 | 6/1987 |

* cited by examiner

*Primary Examiner*—Patrick H Mackey
*Assistant Examiner*—Luis Gonzalez
(74) *Attorney, Agent, or Firm*—Squire, Sanders & Dempsey L.L.P.

(57) ABSTRACT

A sheet feed device of this invention includes a sheet feed tray, a sheet feed unit which feeds a sheet placed on the sheet feed tray, a detection sensor which detects the presence/absence of a sheet on the sheet feed tray, and a sensor mounting member which mounts the detection sensor on the sheet feed tray. The sensor mounting member can mount the detection sensor on the sheet feed tray such that the angle of the sensor can be adjusted with respect to the tray.

5 Claims, 5 Drawing Sheets

SHEET FEED DEVICE

This application is based on and claims priority under 35 U.S.C. § 119 from the Japanese Patent Application No. 2004-241186 filed in Japan on Aug. 20, 2004, the entire content of which is incorporated herein by reference.

BACKGROUND OF THE INVENTION

1. Field of the Invention

The present invention relates to a sheet (such as paper, original) feed device which feeds a sheet placed on a sheet feed tray to a predetermined process position and, more particularly, to a sheet feed device including a detection sensor which detects the presence/absence of a sheet on a sheet feed tray and a sheet length detection sensor which detects the length of a sheet placed on the sheet feed tray by detecting the presence/absence of the sheet.

2. Description of the Related Art

Conventionally, a sheet feed device, which automatically feeds sheets placed on a sheet feed tray to a predetermined process position one by one, has been known. The sheet feed tray of this sheet feed device is provided with a detection sensor which detects the presence/absence of a sheet on the sheet feed tray, a plurality of detection sensors which are arranged along the sheet feed direction to detect the length of the sheet placed on the sheet feed tray by detecting the presence/absence of the sheet, and the like. As detection sensors provided on the sheet feed tray, a lever-type sensor detection scheme (lever-type sensor) or a reflection-type sensor detection scheme (reflection-type sensor) are known. The former scheme is designed to detect the presence/absence of a sheet when the sheet swings a detection lever provided to protrude from the sheet mount surface. The latter scheme is designed to cause light emitted from a light-emitting element to be reflected by a sheet and return to a light-receiving element, thereby detecting the presence/absence of a sheet in accordance with the amount of light returned from the light-emitting element to the light-receiving element.

The lever-type sensor, however, cannot detect a deformed sheet, such as a bent sheet or curled sheet, which is partly floating from the sheet mount surface. In contrast, the reflection-type sensor can detect a sheet even in a state wherein the sheet is slightly floating from the sheet mount surface. However, since the reflection-type sensor is provided on the sheet feed tray so as to face upward, the sensor is easily affected by disturbance light such as light from a fluorescent lamp.

As a sensor designed to solve the problem of disturbance light, a reflection-type sensor based on a pulse modulation scheme is available (see patent reference 1: Japanese Unexamined Patent Publication No. 58-156873). In this scheme, the light-emitting element of the reflection-type sensor is caused to emit light by a driving pulse, and the presence/absence of a sheet is detected by sampling the amount of light received by the light-receiving element at the timing synchronized with this driving pulse. There is also available a scheme of fixing a reflection-type sensor at an angle in a direction different from the direction in which external light directly strikes the light-receiving element of the sensor (see patent reference 2: Japanese Unexamined Utility Model Publication No. 62-96048).

Recently, however, an inverter fluorescent lamp which is pulse-driven at a high frequency is used in many cases. For this reason, in the former case wherein the reflection-type sensor is used, when light from the fluorescent lamp directly strikes the light-receiving element, the sensor malfunctions.

In the latter case, since the reflection-type sensor is fixed in advance in the direction in which external light does not easily enter, if some limitations are imposed on the installation place of the sheet convey apparatus, there is a chance that disturbance light such as light from a fluorescent lamp cannot be effectively avoided, and a detection error may occur.

SUMMARY OF THE INVENTION

The present invention may provide a sheet feed device which can reliably detect the presence/absence of a sheet on a sheet feed tray without receiving any limitation on the installation place of an sheet convey apparatus and without being influenced by disturbance light from an inverter fluorescent lamp or the like.

In order to achieve the above, according to the present invention, there is provided a sheet feed device comprising a sheet feed tray, a sheet feed unit which feeds a sheet placed on the sheet feed tray, a detection sensor which detects the presence/absence of a sheet on the sheet feed tray, and a sensor mounting member to mount the detection sensor such that an angle of the detection sensor can be adjusted.

The above and many other features and advantages of the present invention will become manifest to those skilled in the art upon making reference to the following detailed description and accompanying drawings in which preferred embodiment incorporating the principle of the present invention are shown by way of illustrative examples.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

A preferred embodiment of a sheet feed device according to the present invention will be described in detail below with reference to the accompanying drawings.

The preferred embodiment of a sheet feed device according to the present invention will be described in detail with reference to the accompanying drawings.

Figure 1:
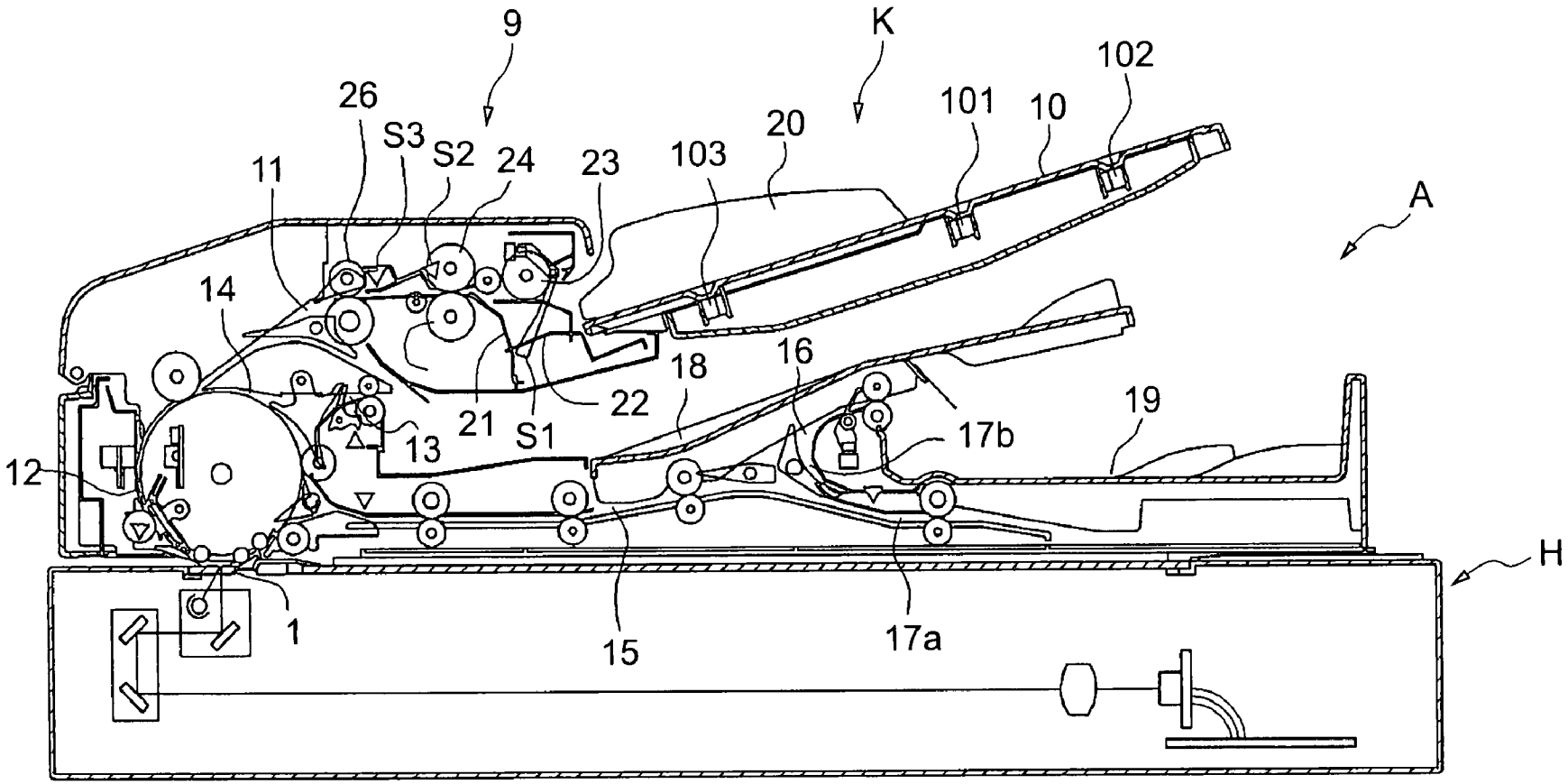
FIG. 1 is a sectional view schematically showing the overall arrangement of a sheet convey apparatus including sheet feed device according to the present invention.

In FIG. 1, a sheet convey apparatus A having a sheet feed device K according to the present invention is shown. The sheet convey apparatus A is mounted on a image reading apparatus main body H. A sheet (such as a paper, original document) sent out from the sheet feed device is conveyed by the sheet convey apparatus A. The sheet passes through the upper surface of a contact glass plate (a glass platen) 1 of the image reading apparatus main body H, and then is delivered onto a delivery tray.

The sheet convey apparatus A includes the sheet feed device K having a sheet feed tray 10 for placing a plurality of sheets on it, and first and second delivery trays 18 and 19 which store the sheets read by the image reading apparatus main body H. The first delivery tray 18 mainly stores large-sized sheets, and the second delivery tray 19 stores small-sized sheets.

The sheet convey apparatus A has a plurality of sheet convey paths extending from the sheet feed device K to the first and second delivery trays 18 and 19 via the image reading apparatus main body H. First, a sheet feed path 11 conveys the sheet sent out from the sheet feed tray 10. A convey path 12 extends from the sheet feed path 11 to the contact glass plate 1 of the image reading apparatus main body H. A first delivery path 13 continues from the convey path 12 to the delivery port to the first delivery tray 18. In addition, an intermediate path 15 is formed by diverging from the first delivery path 13. A second delivery path 16 continues from the intermediate path 15 to the delivery port of the second delivery tray 19. A switchback path 17*a* branches from the second delivery path 16 to switch back the sheet set from the intermediate path 15. A reversal path 17*b* turns over the switch-backed sheet and guides it to the delivery port to the second delivery tray 19. A circulation path 14 returns the switch-backed sheet to the connecting portion of the sheet feed path 11 and convey path 12 via the intermediate path 15 and sends it to the convey path 12 again. These sheet convey paths form the sheet feed path.

The sheet feed device K includes the sheet feed tray 10 described above and a sheet feed unit 9 for picking up the sheets one by one from the sheet feed tray 10 and conveys them to the sheet feed path 11. The sheet feed tray 10 is provided with a side guide 20 which regulates the side ends of the sheets placed on the sheet feed tray 10. A stopper member 21 is arranged in the vicinity of the distal end of the sheet feed tray 10 to regulate the leading edges of the sheets placed on the sheet feed tray 10. The sheet feed tray 10 is attached to be pivotal about the leading edge side in the sheet convey direction.

The sheet feed unit 9 includes a pickup roller 23, elevating plate 22, sheet feed roller 24, separation roller 25, and registration roller pair 26. The pickup roller 23 sends out the sheet. The elevating plate 22 lifts up the leading edges of the sheets placed on the sheet feed tray 10 to bring them into contact with the pickup roller 23. The sheet feed roller 24 supplies a sheet picked up by the pickup roller 23. The separation roller 25 allows only the uppermost one of the sheets placed on the sheet feed tray 10 to pass through, and inhibits conveyance of the second and following sheets. The registration roller pair 26 aligns the supplied sheets which are separated by the separation roller 25 by abutting against the leading edges of the sheets, and sends them downstream. The pickup roller 23, sheet feed roller 24, and registration roller pair 26 are operationally connected to a sheet feed motor (not shown), and made to rotate by the normal or reverse drive of the sheet feed motor.

A sheet feed tray 10 is provided with an empty sensor S1 on the downstream side in the sheet feed direction. The empty sensor S1 detects that a sheet is placed on the sheet feed tray 10. A sheet feed path 11 is provided with a length sensor S2 and registration sensor S3 which detect an end portion of the sheet fed from the sheet feed tray 10. The sensors S1, S2, and S3 are connected to a control unit including a CPU or the like for controlling the conveyance of sheets. Sheet conveying operation is executed on the basis of output signals from the respective sensors.

In addition, the sheet feed tray 10 is provided with length detection sensors 101 and 102 for detecting the length of a sheet by detecting the presence of the sheet and a last sheet detection sensor 103, which are arranged along the sheet feed direction, for detecting a last sheet detecting by detecting a the presence of a sheet. The present embodiment is characterized by mounting members for the detection sensors 101, 102, and 103. Each of the detection sensors 101, 102, and 103 is a reflection-type detection sensor including a light-emitting element and light-receiving element, and is mounted on the lower surface side of the sheet feed tray 10 through a sensor holder. The detection sensors 101, 102, and 103 are arranged at predetermined intervals along the sheet feed direction of the sheet feed tray 10, and are located in the almost middle of the sheet feed tray 10 in the widthwise direction. Note that a side guide 20 is provided with a volume which detects the position of the guide. The length of a sheet placed on the sheet feed tray 10 in the widthwise direction is detected from an output voltage value from this volume. The size of the sheet is then discriminated from the detection result obtained by the width sensor (not shown) which detects the position of the side guide 20 and the detection result which is obtained by the length detection sensors 101 and 102 and indicates the presence/absence of a sheet. Assume that the sizes of sheets to be handled include A5 horizontal, A5 vertical, A4 horizontal, A4 vertical, B4 vertical, and A3 vertical. In this case, the sizes of sheets having different sizes in the widthwise direction can be specified by detection results from the width sensor, but the sizes of sheets having the same size in the widthwise direction cannot be specified by only detection results from the width sensor. That is, the length detection sensors 101 and 102 are provided to identify sheets which have the same size in the widthwise direction and whose sizes cannot be specified by only detection results from the width sensor. For example, the first length detection sensor 101 is provided to identify A5 horizontal and A4 vertical. The second length detection sensor 102 is provided to identify B5 horizontal, B4 vertical, A4 horizontal, and A3 vertical. Note that the last sheet detection sensor 103 described above is placed at a position on the distal end side of the sheet feed tray 10, and serves to detect the trailing end of the last sheet fed from the sheet feed tray 10.

Sensor mounting members for the length detection sensors 101 and 102 and last sheet detection sensor 103 will be described next. All the length detection sensors 101 and 102 and last sheet detection sensor 103 are mounted on the sheet feed tray 10 by similar sensor mounting members. Therefore, these sensors will be generically referred to as a reflection-type detection sensor and will be described below.

Figure 2:
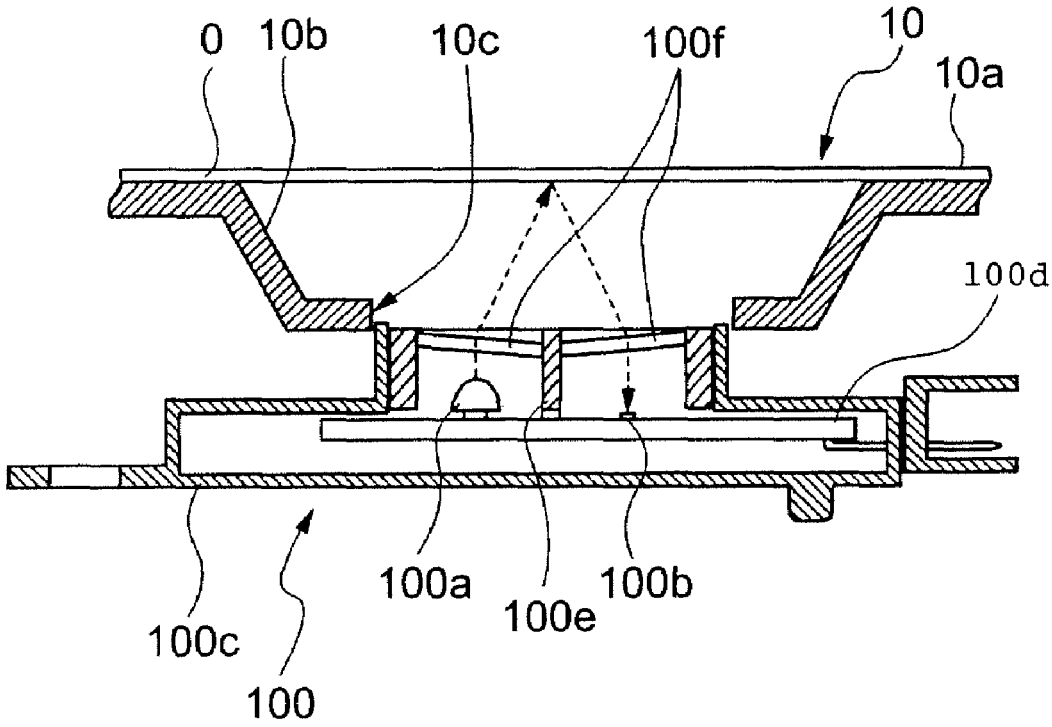
FIG. 2 is a sectional view schematically showing a reflection-type detection sensor.

FIG. 2 is a view showing the arrangement of the reflection-type detection sensor 100, which is comprised of a case 100*c* whose exterior is made of a resin, a sensor board 100*d* provided in the case 100*c*, a light-emitting element 100*a* and light-receiving element 100*b* which are mounted side by side on the sensor board 100*d*, a partition 100*e* which separates the light-emitting element 100*a* from the light-receiving element 100*b*, and film-like lens portions 100*f* which cover the upper portions of the light-emitting element 100*a* and light-receiving element 100*b*. The lens portion 100*f* becomes the detection surface of the reflection-type detection sensor 100. Light emitted from the light-emitting element 100*a* and light received by the light-receiving element 100*b* are detected through the lens portions 100*f*. The reflection-type detection sensors 100 are provided on the rear surface side of a recess 10*b* formed in a sheet mount surface 10*a* of the sheet feed tray 10, and are mounted such that the lens portions 100*f* are exposed to the sheet mount surface 10*a* through an opening portion 10*c* formed in the bottom wall of the recess 10*b*.

In this embodiment, the reflection-type detection sensor 100 is formed as a sensor unit having the light-emitting element 100*a* and light-receiving element 100*b* housed in one case 100*c*, and is held on a sensor holder 201 serving as a sensor mounting member. First and second holding portions 202 and 203 for holding the reflection-type detection sensor 100 are provided parallel on diagonal lines on a rectangular base board 209 of the sensor holder 201. The first holding portion 202 is provided with a pair of holding pawls 202*a* and 202*b* facing each other through an opening portion 204 of the first holding portion 202. One end side of the case 100*c* of the reflection-type detection sensor 100 is inserted between the holding pawls 202*a* and 202*b*, and the other end side is supported by a boss 208 extending vertically from the base board 209. This makes it possible to mount the reflection-type detection sensor 100 almost parallel (a reference position in the horizontal direction) to the base board 209.

Like the first holding portion 202, the second holding portion 203 is provided with a pair of holding pawls 203*a* and 203*b* facing each other through an opening portion 205. In addition, a projection 203*c* in the form of a square bar is provided near the inside space between the holding pawls 203*a* and 203*b* on the base board 209. The projection 203*c* is provided to mount the reflection-type detection sensor 100 at an angle. Abutting the reflection-type detection sensor 100 against the projection 203*c* when making the second holding portion 203 hold the sensor allows the reflection-type detection sensor 100 to be mounted on the base board 209 at a predetermined angle (tilt position). Note that the sensor holder 201 is provided with holder fixing pieces 201*a* and 201*b* on diagonal lines on the opposite side to the first and second holding portions 202 and 203. Each of these holder fixing pieces is formed by extending a portion of the base board 209 of the sensor holder 201 in an L shape. Mounting holes 206*a* and 206*b* are formed in the upper surfaces of the holder fixing pieces. In this embodiment, one of the mounting holes is formed into the round hold 206*a*, and the other is formed into the long hole 206*b*.

On the rear surface side of the recess 10*b* formed in the sheet feed tray 10, first columns 10*d* and 10*e* and second columns 10*f* and 10*g* for fixing the sensor holder 201 are formed in pairs around the recess 10*b*. In this embodiment, like the sensor holder 201 described above, the first columns 10*d* and 10*e* and second columns 10*f* and 10*g* constitute part of the sensor mounting member. The columns 10*d* and 10*g* are formed near the recess 10*b*, and the columns 10*e* and 10*f* are formed slightly apart from the recess 10*b*. Hollow holes 10*h* of the columns 10*d*, 10*e*, 10*f*, and 10*g* are provided with female screws. The sensor holder 201 can therefore be fixed on the rear surface side of the sheet feed tray 10 by positioning the holder fixing pieces 201*a* and 201*b* of the sensor holder 201 to these columns and inserting screws 207 into the columns through the mounting holes 206*a* and 206*b*. In this case, the posture of the reflection-type detection sensor 100 with respect to the sheet feed tray 10 can be changed by either making the first and second holding portions 202 and 203 of the sensor holder 201 hold the reflection-type detection sensor 100 or by making the first columns 10*d* and 10*e* and second columns 10*f* and 10*g* of the sensor holder 201 fix the reflection-type detection sensor 100.

Figure 4A:
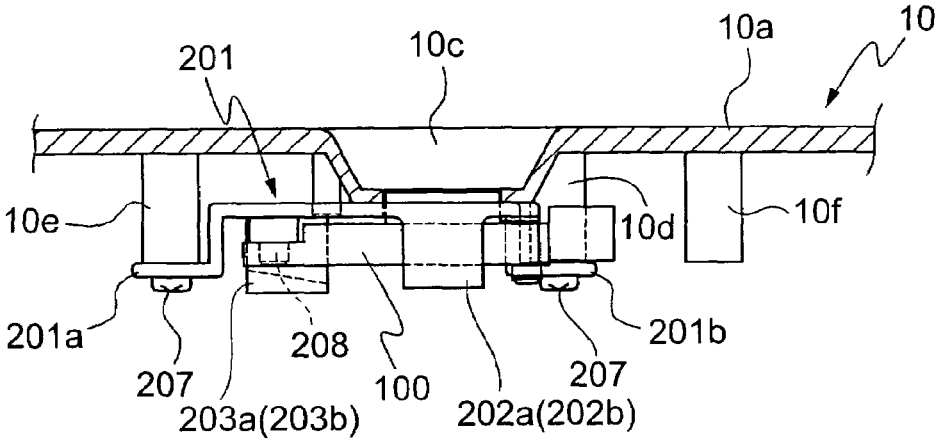
FIGS. 4A to 4C are views respectively showing different mounted states of the reflection-type detection sensor.

Which posture the reflection-type detection sensor 100 holds with respect to the sheet feed tray 10 will be described in detail next with reference to FIGS. 4A to 4C. First of all, as shown in FIG. 4A, when the reflection-type detection sensor 100 is held by the first holding portion 202 and boss 208 of the sensor holder 201, and the holder fixing pieces 201*a* and 201*b* of the sensor holder 201 are respectively fixed to the columns 10*d* and 10*e* with the screws 207 upon being positioned to the respective columns, the reflection-type detection sensor 100 can be placed almost parallel to the sheet mount surface 10*a* of the sheet feed tray 10.

Figure 4B:
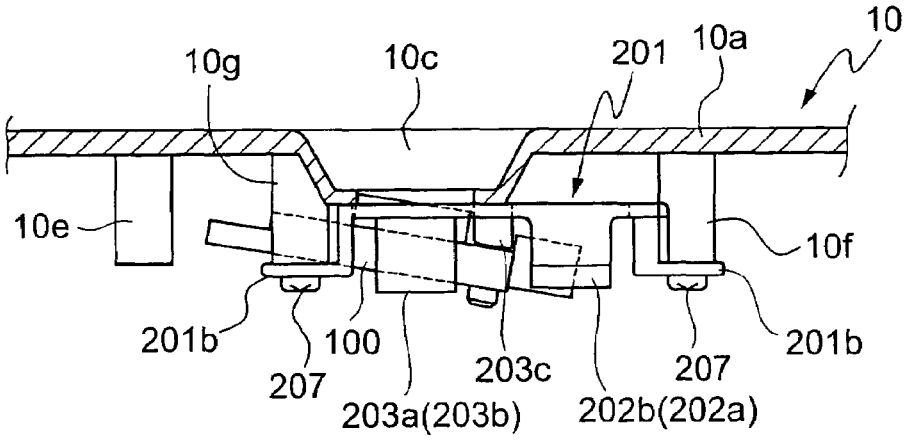

As shown in FIG. 4B, when the reflection-type detection sensor 100 is held by the second holding portion 203 and projection 203*c* of the sensor holder 201 in a tilted state, and the holder fixing pieces 201*a* and 201*b* of the sensor holder 201 are respectively fixed to the columns 10*f* and 10*g* with the screws 207 upon being positioned to the respective columns, the reflection-type detection sensor 100 can be placed at a predetermined angle on one side (the clockwise direction in FIG. 4B) with respect to the sheet mount surface 10*a* of the sheet feed tray 10.

Figure 3:
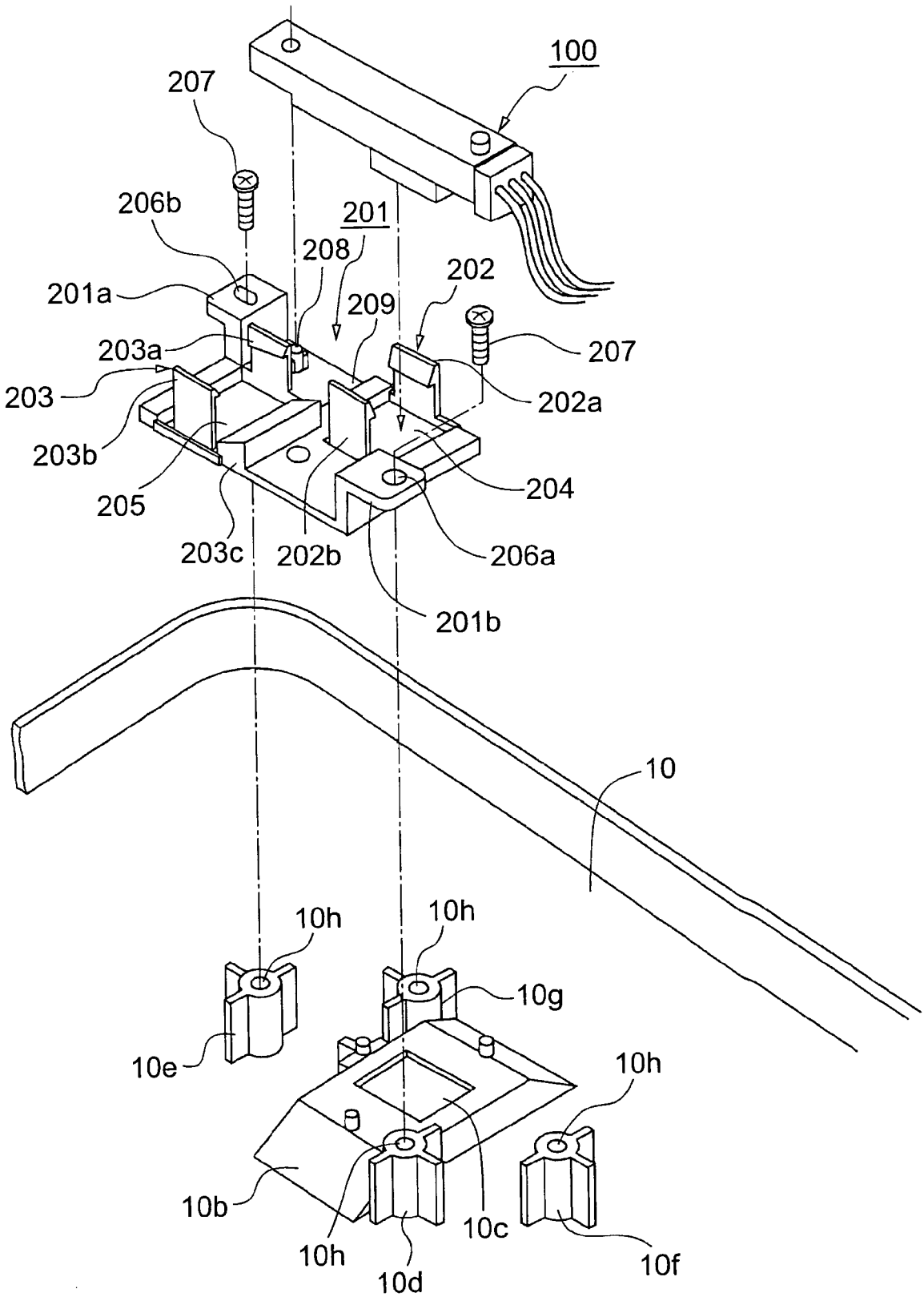
FIG. 3 is an exploded perspective view showing a mount structure for the reflection-type detection sensor.
Figure 4C:
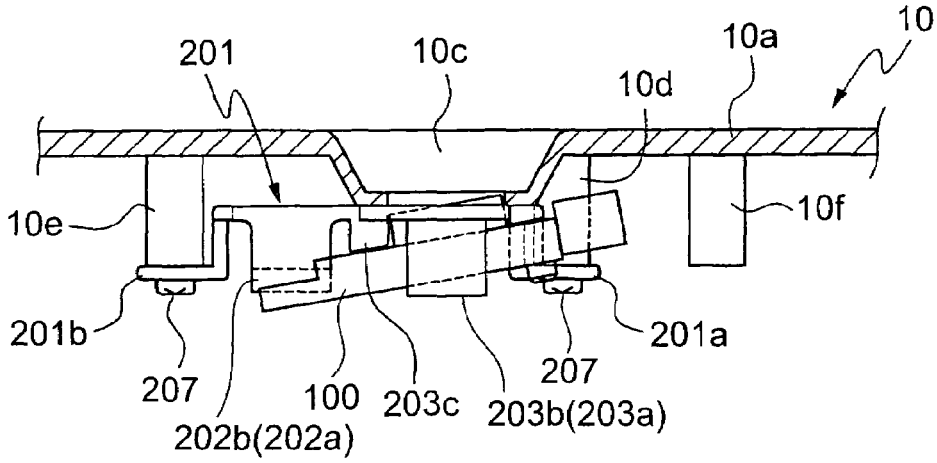

As shown in FIG. 4C, when the reflection-type detection sensor 100 is held by the second holding portion 203 and projection 203*c* of the sensor holder 201 upon being rotated through 180° with respect to the state shown in FIG. 3, and the holder fixing pieces 201*b* and 201*a* of the sensor holder 201 are respectively fixed to the columns 10*d* and 10*e* with the screws 207 upon being positioned to the respective columns, the reflection-type detection sensor 100 can be placed at a predetermined angle in the opposite direction (in the counterclockwise direction in FIG. 4B) to that in FIG. 4B.

Figures 5A, 5B, 5C:
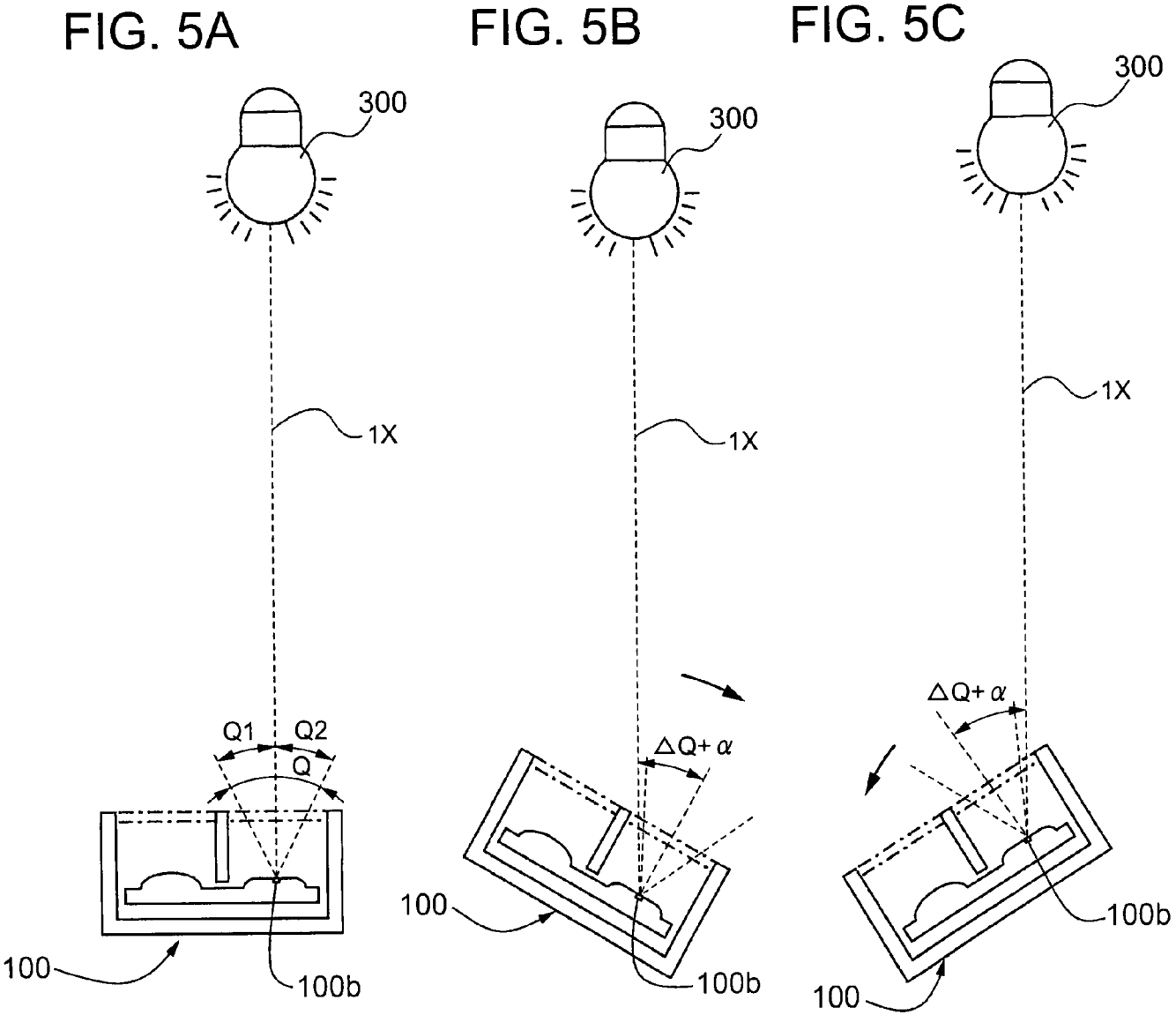
FIGS. 5A to 5C are views each showing how disturbance light from a fluorescent lamp is avoided by tilting the reflection-type detection sensor.

FIGS. 5A to 5C show the relationship between the tilt angle of the reflection-type detection sensor 100 and an operation error. In this case, the light-receiving element 100*b* of the reflection-type detection sensor 100 is placed immediately below an inverter fluorescent lamp 300. FIG. 5A shows a case wherein the reflection-type detection sensor 100 is mounted almost parallel to the sheet mount surface 10*a* of the sheet feed tray 10. Assume that an operation error occurs when direct light 1× from the fluorescent lamp 300 strikes within a detection angle θ (range) set by the directivity characteristics of the light-receiving element 100*b* of the reflection-type detection sensor 100. That is, in the case shown in FIG. 5A, an operation error may occur in the reflection-type detection sensor 100.

In such a case, the reflection-type detection sensor 100 is tiled clockwise by an angle $\Delta\theta 1+\alpha$ as shown in FIG. 5B, or may be tilted counterclockwise by an angle $\Delta\theta 2+\alpha$ as shown in FIG. 5C. This makes the direct light 1× from the fluorescent lamp 300 fall outside the detection angle θ (range) of the light-receiving element 100*b* and can prevent the occurrence of an operation error in the reflection-type detection sensor 100. In addition, when an operation error occurs due to disturbance light at a given tilt angle position, an operation error due to disturbance light can be easily prevented by changing the tilt angle to one of the two remaining angles. That is, all disturbance light can be coped with by changing the angle position of the reflection-type detection sensor to one of three angles without requiring to set many angle positions.

In this embodiment, considering the fact that once an image reading apparatus main body H including a sheet convey apparatus A is installed, there is a low possibility that the installation place will be frequently changed, the angle of the reflection-type detection sensor 100 is changed depending on how the sensor holder 201 is mounted. However, the reflection-type detection sensor 100 may be swingably supported by the sensor holder 201 so as to allow the angle of the reflection-type detection sensor 100 to be changed by external operation using an operation member such as a change dial or change lever, thereby holding the sensor at a predetermined angle with a holding member such as a lock pawl. Alternatively, the angle of the sensor can be automatically changed by using an actuator (driving unit) such as a motor or solenoid.

As described above, according to the sheet feed device of the present invention, when the reflection-type detection sensor 100 malfunctions upon direct application of disturbance light from the inverter fluorescent lamp 300 or the like, such a trouble can be reliably prevented by only changing the mounting angle of the reflection-type detection sensor 100. In addition, the mounting angle can also be easily changed by only changing the mounting position or direction of the reflection-type detection sensor 100 with respect to the sensor holder 201, or by only changing the mounting position of the sensor holder 201 with respect to the sheet feed tray 10.

Furthermore, since the sheet feed device of the present embodiment is designed such that the reflection-type detection sensor 100 tilts only in the direction perpendicular to the sheet feed direction of the sheet feed tray 10, the detection position in the length direction of a sheet does not change even if the angle of the reflection-type detection sensor 100 is changed. This makes it possible to reliably detect the presence/absence of a sheet. In the above embodiment, since the positions of the light-emitting element 100*a* and light-receiving element 100*b* do not change, the extending directions of interconnections from connectors do not change. This greatly facilitates handling of the elements.

According to the sheet feed device of the present invention, since the sensor mounting member to mount the detection sensor such that its angle can be adjusted is provided, if there is a possibility that the detection sensor will malfunction due to the influence of disturbance light from a fluorescent lamp or the like when the sheet convey apparatus is installed, the angle of the sensor can be adjusted to avoid the influence of disturbance light, and the angle of the sensor can be easily adjusted.

What is claimed is:

1. A sheet feed device, comprising:

a sheet feed tray on which a sheet is placed;

a sheet feed unit which feeds a sheet placed on the sheet feed tray;

a detection sensor unit which detects the presence/absence of a sheet on the sheet feed tray, wherein the detection sensor unit integrally includes a light-emitting element which emits light to a sheet and a light-receiving element which receives light reflected on a sheet; and a sensor mounting member to mount the detection sensor unit, wherein the sensor mounting member has an angle changing mechanism which can adjust an angle of the detection sensor unit in a direction perpendicular to a sheet feed direction and a sheet mount surface of the sheet feed tray, wherein the angle changing mechanism can change the position of the detection sensor unit to a reference position substantially parallel to the sheet mount surface of the sheet feed tray and a tilt position at a predetermined angle on one side with respect to the sheet mount surface of the sheet feed tray in either of directions perpendicular to the sheet feed direction, and wherein a fixing direction of the sensor mounting member to the sheet feed tray is changeable by 180 degrees and the predetermined angle of the detection sensor unit to the sheet mount surface changes to an opposite side by changing the fixing direction of the sensor mounting member to the sheet feed tray by 180 degrees.

2. The sheet feed device of claim 1, wherein the detection sensor unit comprises a plurality of detection sensor units arranged along the sheet feed direction on the sheet feed tray and wherein the angle changing mechanism is provided for each of the plurality of detection sensor units arranged along the sheet feed direction on the sheet feed tray, and an angle of each of the detection sensor units can be adjusted.

3. A device according to claim 2, wherein a sheet length is detected based on the detection of the presence/absence of the sheet by the detection sensor unit.

4. A device according to claim 2, wherein a sheet size is detected based on the detection of the presence/absence of the sheet by the detection sensor unit.

5. A device according to claim 1, wherein a last sheet is detected based on the detection of the presence/absence of the sheet by the detection sensor unit.

* * * * *